US005822900A

United States Patent [19]

Armstrong

[11] Patent Number: 5,822,900

[45] Date of Patent: Oct. 20, 1998

[54] VEHICLE SIGNALLING DEVICE WITH TRIGGER GRIP OPERATION

[76] Inventor: William C. Armstrong, P. O. Box 3191, St. Augustine, Fla. 32085

[21] Appl. No.: 684,593

[22] Filed: Jul. 19, 1996

[51] Int. Cl.[6] ..... G09F 11/02

[52] U.S. Cl. ..... 40/473; 40/506; 40/593; 40/597

[58] Field of Search ..... 40/473, 486, 502, 40/506, 591, 593, 597; 340/815.73, 815.86

[56] References Cited

U.S. PATENT DOCUMENTS

| | | | |
|---|---|---|---|
| 1,286,825 | 12/1918 | Stern et al. | 40/502 X |
| 1,846,858 | 2/1932 | Glaser et al. | 40/502 X |
| 1,856,519 | 5/1932 | Spears . | |
| 2,481,941 | 9/1949 | Morton | 40/502 X |
| 2,530,044 | 11/1950 | Castillon | 40/502 |
| 4,067,128 | 1/1978 | Kempster | 40/473 |
| 4,574,269 | 3/1986 | Miller . | |
| 4,787,163 | 11/1988 | Berg | 40/592 |
| 4,860,476 | 8/1989 | Hall . | |
| 4,876,811 | 10/1989 | Peltz . | |
| 4,953,315 | 9/1990 | Romaine . | |
| 5,099,594 | 3/1992 | Reas et al. . | |
| 5,235,768 | 8/1993 | Eder . | |
| 5,241,768 | 9/1993 | Thompson . | |
| 5,386,960 | 2/1995 | O'Brien . | |

*Primary Examiner*—Brian K. Green
*Attorney, Agent, or Firm*—Kenyon & Kenyon

[57] ABSTRACT

The vehicle signalling device 2 comprises a frame 10, a rotating drum 40 having multiple sides 46 mounted to the frame 10 for displaying predetermined messages, a pivoting shutter 100 mounted to the frame 10 that shields an observable view of the drum 40 as the drum 40 rotates to the desired message for display and a hand-held trigger grip 206 operatively and independently connected to the drum 40 and the shutter 100 for selective activation. The drum 40 rotates by activating an index arm 64 and a first pawl 74 assembly engaging a first ratchet wheel 56 mounted to a drum first end wall 42. The drum 40 and the shutter 100 are activated by either transferring a force supplied by an operator's hand, or by activating electric first and second motors 278 and 288, respectively. Also, the drum 40 can be illuminated by a lamp 318 mounted within the drum 40.

33 Claims, 4 Drawing Sheets

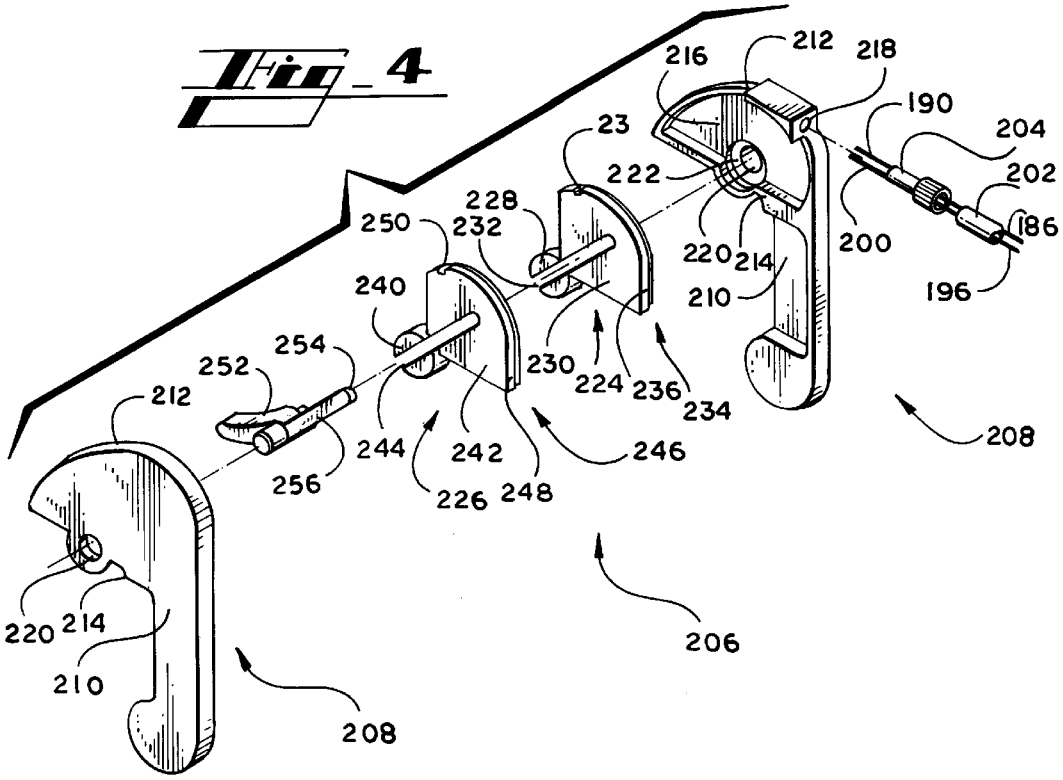
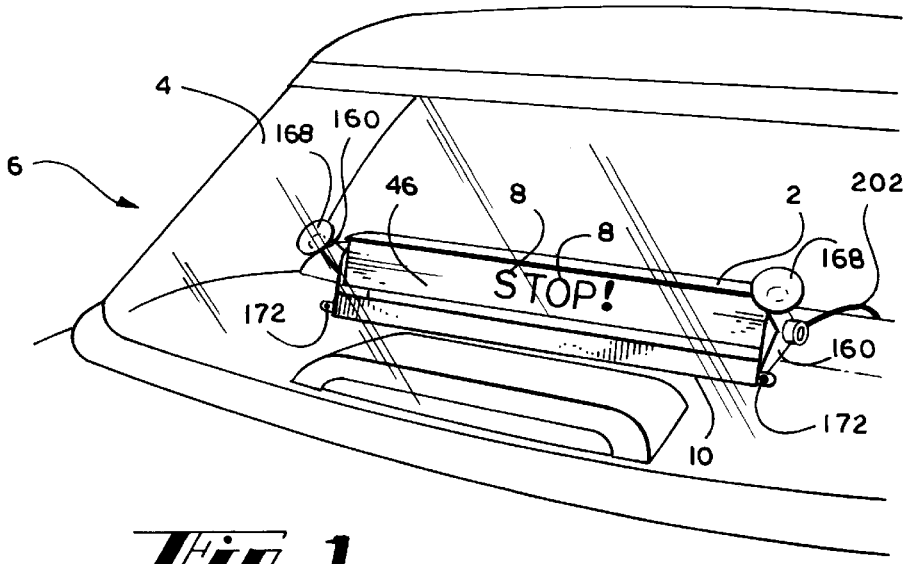
Fig_1

VEHICLE SIGNALLING DEVICE WITH TRIGGER GRIP OPERATION

BACKGROUND OF THE INVENTION

I. Field of the Invention

The present invention relates generally to the field of devices for displaying messages in the windows of motor vehicles. More particularly, the present invention relates to a multi-message, visual communicator for a rear or side window of a vehicle.

II. Description of the Related Art

Messages have been commonly displayed upon or within motor vehicles over the years. These vary from painting the message directly upon the vehicle, such as a company name, or applying message bearing stickers, which relate to almost any issue, to the vehicle bumpers, body or windows. However, use of this media has proven limiting in that the message does not change and is somewhat permanently mounted to the vehicle. To remove or change the message born by these types of media, costly and extraordinary efforts must be taken to remove the message. For example, to remove a painted message, the area containing the message generally must be repainted. Further, to change or remove the stickers, it is sometimes necessary to remove the sticker, which can be destructive to vehicle surfaces by creating scratches or revealing areas discolored due to the presence of the sticker.

Several devices listed under U.S. Pat. Nos. 1,856,519, 4,860,476, 4,876,811, 5,099,594, 5,235,768, and 5,386,960 detail devices which convey messages from a vehicle. None of these devices disclose the novel features of the present invention.

A vehicle communicator described in U.S. Pat. No. 4,574,269 by Miller has a semi-transparent window screen disposed within an adjustable frame adapted for mounting to the rear window of a vehicle for viewing from outside of the vehicle. A message display unit having a plurality of light emitting diodes is supported by the window screen. The light emitting diodes are selectively energized to emit light in the form of a message by a message control unit.

U.S. Pat. No. 4,953,315 granted to Romaine describes a display device for vehicles for use in either side or rear windows of the vehicle. The device has an elongated case with a plurality of spaced display windows along a front face. Within the case is an elongated slide having a plurality of spaced indicia spelling out two messages. Inertial, centrifugal or gravitational forces generated by the movement of the vehicle cause the slide to move between two positions. The display windows and the indicia are positioned in a manner that upon relative movement of slide and case, the alternate messages are displayed. Suction cups are utilized to mount the display device to the vehicle.

A message holder described in U.S. Pat. No. 5,241,768 by Thompson describes a message holder for use in either vehicles or buildings. The device is formed having at least one sheet of transparent material and a central space in which a message may be temporarily installed for display. Suction cups are used to mount the device to any suitable surface.

SUMMARY OF THE INVENTION

In accordance with the present invention and the contemplated problems which have and continue to exist in this field, the objectives of this invention are to provide a device:

that is simple to Mount in a vehicle;

which is easily observable;

which can relay several messages to a viewer;

that permits an operator to selectively shield the message from the viewer;

that can be seen at night;

which informs the operator precisely which message is viewable; and which is inexpensive to fabricate and assemble.

This invention accomplishes the above and other objectives and overcomes the disadvantages of the prior art by providing a vehicle signalling device with trigger grip operation that is simple in design and construction, inexpensive to fabricate, and easy to use. The vehicle signalling device comprises a frame, a multiple sided rotating drum mounted to the frame for displaying predetermined messages, a pivoting shutter mounted to the frame that shields an observable view of the drum as the drum rotates to the desired message for display and a hand-held trigger grip operatively and independently connected to the drum and the shutter for selective activation. The drum rotates by activating an index arm and pawl assembly engaging a ratchet wheel mounted to a side wall of the drum. The drum and the shutter are activated by either transferring a force supplied by an operator's hand, or by activating electric motors. Also, the drum may be illuminated by a lamp mounted within the drum.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Other objects, advantages and capabilities of the invention will become apparent from the following description taken in conjunction with the accompanying drawings showing preferred embodiments of the invention.

BRIEF DESCRIPTION OF THE DRAWINGS

The invention will be better understood and the above objects, as well as objects other than those set forth above, will become apparent when consideration is given to the following detailed description thereof. Such description makes reference to the annexed drawings wherein:

FIG. 1 is a perspective view of a vehicle signalling device mounted to a rear window of a vehicle;

FIG. 4 is an exploded, perspective view of a trigger grip operationally connected to the embodiment shown in FIG. 2;

DESCRIPTION OF THE PREFERRED EMBODIMENTS

Figure 2:
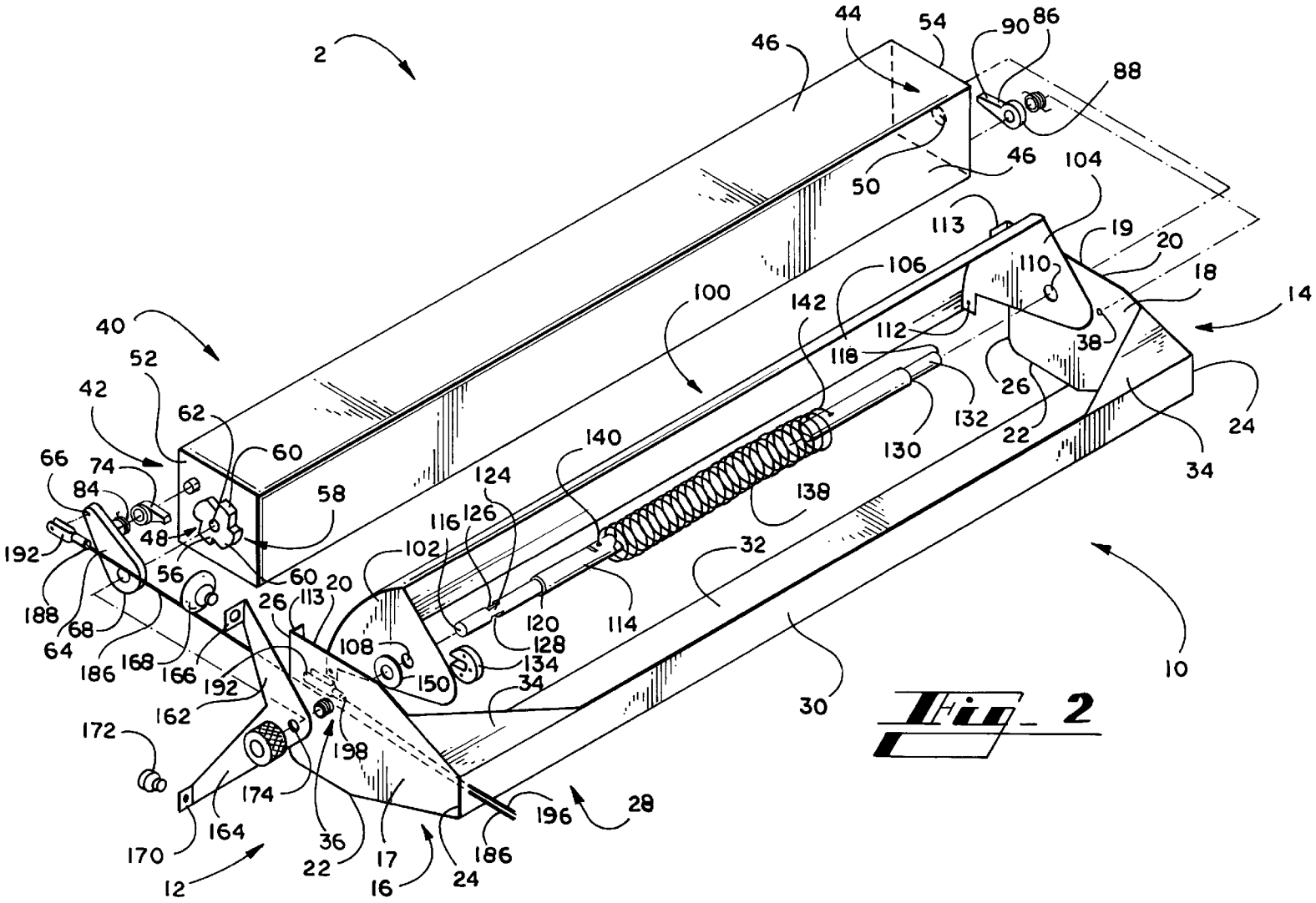
FIG. 2 is an exploded, perspective view of one embodiment of the vehicle signalling device.

For a fuller understanding of the nature and desired objects of this invention, reference should be made to the following detailed description taken in connection with the accompanying drawings. Referring to the drawings wherein like reference numerals designate corresponding parts throughout the several figures, reference is made first to FIG. 1. FIG. 1 of the drawings generally illustrates a vehicle signalling device 2 mounted to a rear window 4 of a vehicle 6. Indicia 8 are provided for conveying a predetermined message for viewing from outside of the vehicle 6 by an observer.

Figures 3, 6:
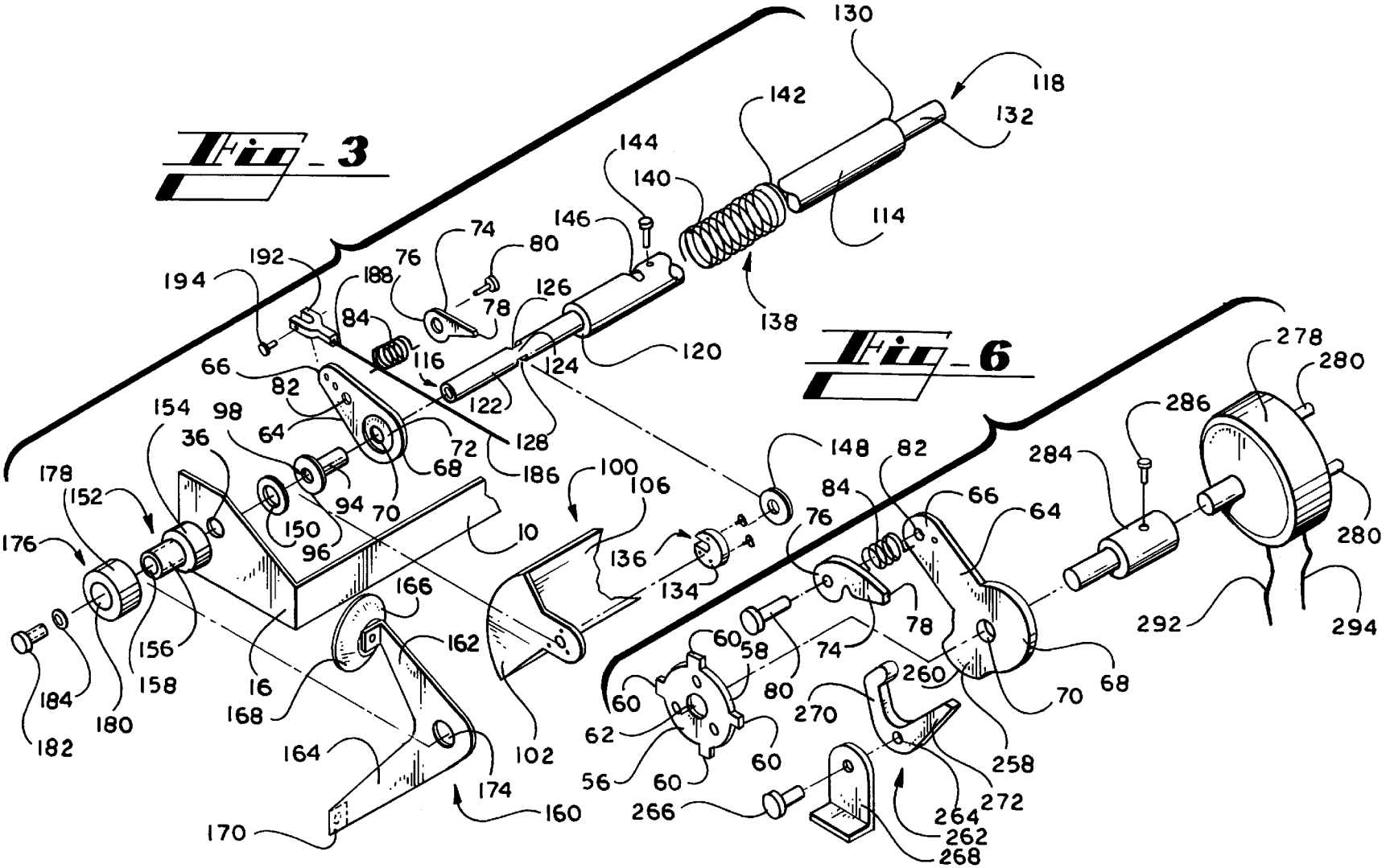
FIG. 3 is a partial and exploded, perspective view of an axle in relationship to a frame and a shutter of the embodiment of FIG. 2.
FIG. 6 is an exploded, perspective view of an arm and a pawl in relationship to a first motor of the embodiment shown in FIG. 5.

Referring to the embodiment shown in FIGS. 2–4, reference is next made to FIG. 2. This embodiment of the vehicle signalling device 2 has a frame 10 with a frame first end 12 and a frame second end 14. At the frame first and second ends 12 and 14 are a frame first end wall 16 and a frame second end wall 18, respectively. The frame first end wall 16 has a frame first end wall outer surface 17 and the frame second end wall 18 has a frame second end wall outer surface 19. Preferably, the frame first and second end walls 16 and 18 are identically shaped and oriented parallel to one another. The frame first and second end walls 16 and 18 have a wall top edge 20, a wall bottom edge 22, a wall front edge 24 and a wall rear edge 26. Disposed between the frame first and second end walls 16 and 18 is an elongated frame brace 28. In this embodiment the frame brace 28 is in an L-shaped configuration, which forms a first brace side 30 and a second brace side 32. The first brace side 30 is mounted to the frame first and second end walls 16 and 18 proximate the wall front edges 24 at the first and second ends 12 and 14, respectively. Also, the second brace side 32 is mounted to the frame first and second end walls 16 and 18 proximate the wall bottom edges 22 at the first and second ends 12 and 14, respectively. Although not required, angle braces 34 are mounted to the top edges 20 of the first and second end walls 16 and 18 and the first brace side 30 to provide additional rigidity within the frame 10. The frame first and second end walls 16 and 18 have a frame first bore 36 and a frame second bore 38, respectively. The frame first and second bores 36 and 38 are concentrically disposed opposite one another. A line between the origins of the frame first and second bores 36 and 38 defines a longitudinal axis.

Rotatably mounted to the frame first and second end walls 16 and 18 is an elongated, polygonal drum 40. The drum 40 has a drum first end wall 42, which is opposite the frame first end wall 16 and a drum second end wall 44, which is opposite the frame second end wall 18. Preferably, the drum first and second end walls 42 and 44 are identically shaped and oriented parallel to one another. Disposed between the drum first and second end walls 42 and 44 are the plurality of sides 46. As shown in FIG. 1, each side 46 has indicia 8 for conveying the predetermined message for viewing from outside of the vehicle 6. The indicia 8 can be either permanently or temporarily attached to each side 46. Centrally located on the drum first end wall 42 is a drum first bore 48. Likewise, centrally located on the drum second end wall 44 is a drum second bore 50. For clarity purposes, the drum second end wall 44 and the drum second bore 50 are shown in phantom on FIG. 2. The drum first and second bores 48 and 50 are concentric with the frame first and second bores 36 and 38, respectively, and are aligned along the longitudinal axis. Additionally, the drum first and second end walls 42 and 44 have drum first and second end outer surfaces 52 and 54, respectively.

Centrally mounted to the drum first end outer surface 52 is a first ratchet wheel 56. The first ratchet wheel 56 has a first wheel circumferential surface 58 and a plurality of first teeth 60 pending from the first wheel circumferential surface 58. Although the number of first teeth 60 may exceed the number of sides 46 of the drum 40, it is preferred for the number of first teeth 60 to equal the number of sides 46. Also, the first ratchet wheel 56 has a first wheel bore 62 that is concentric with the drum first bore 48 and aligns along the longitudinal axis.

Referring to FIGS. 2 and 3, an index arm 64 is shown having an arm mount end 66 and an arm pivot end 68. The index arm 64 is pivotally mounted to the frame first end wall 16 proximate the arm pivot end 68 and adjacent to the drum first end wall 42. Proximate the arm pivot end 68 is an index bore 70. The index bore 70 is concentric with the drum first bore 48 and aligns along the longitudinal axis. Disposed adjacent to and concentric with the index bore is an index recess 72.

Acting in union with the index arm 64 is a first pawl 74 having a first pawl pivot end 76 and a first pawl outer end 78. Proximate the first pawl pivot end 76, the first pawl 74 is pivotally mounted to the index arm 64 proximate the arm mount end 66 by a pawl mounting screw 80. The pawl mounting screw 80 matingly engages a first threaded hole 82. Preferably, as the index arm 64 pivots toward the drum 40, the first pawl outer end 78 removably and matingly engages a first tooth 60 of the first ratchet wheel 56. Engaging the first pawl 74 and biasing the first pawl outer end 78 in contact with the first ratchet wheel 56 is a first pawl spring 84. The first pawl spring 84 is disposed between the index arm 64 and the first pawl 74 over the pawl mounting screw 80.

Mounted to the drum second end outer surface 54 is a second ratchet wheel (not shown). The second ratchet wheel has a second wheel circumferential surface (not shown) and a plurality of second teeth (not shown) pending from the second wheel circumferential surface. Generally, the second ratchet wheel has the same configuration as the first ratchet wheel 56. Like the first ratchet wheel 56, the number of second teeth may exceed the number of sides 46 of the drum 40. Preferably, however, the number of second teeth equals the number of sides 46. Like the first ratchet wheel 56, the second ratchet wheel has a second wheel bore that is concentric with the drum second bore 50 and aligns along the longitudinal axis with the drum first bore 48.

A second pawl 86 having a second pawl pivot end 88 and a second pawl outer end 90 is pivotally mounted to the frame second end wall 18 proximate the second pawl pivot end 90. The second pawl outer end 90 slidingly engages the second wheel circumferential surface as the drum 40 rotates in one direction to a stopping point, displaying the desired side 46. At the stopping point, the second pawl outer end 90 removably and matingly engages at least one second tooth of the second ratchet wheel, preventing the drum 40 from rotating in the opposite direction.

Disposed between the second pawl 86 and the frame second end wall 18 is a second pawl spring 92. The second pawl spring 92 engages the second pawl 86 to bias the second pawl outer end 90 in contact with the second ratchet wheel circumferential surface.

A cylindrically-shaped first spool 94 having a first spool flange 96 is disposed through the index bore 70. The first spool flange 96 matingly engages the index recess 72 and is mounted to the index arm 64 at the first spool flange 96. A first spool bore 98 is disposed through the first spool 94, which is concentric with the index bore 70 and aligns along the longitudinal axis.

To selectively shield a view of the side 46 of the drum 40 which is viewable from outside of the vehicle 6, a shutter 100 is pivotally mounted to the frame 10. An operator can utilize the shutter 100 to block the observer's view while the drum 40 is rotating to the desired side 46. Once the desired side 46 is in place, the shutter 100 can be pivoted above or below the drum 40 to reveal the message to the observer. In the preferred embodiment, the shutter 100 pivots above the shutter 100. The shutter 100 has a shutter first end wall 102, a shutter second end wall 104 and an elongated blind 106 disposed between the shutter first and second end walls 102 and 104. Located on the shutter first end wall 102 is a shutter first end bore 108 and on the shutter second end wall 104 is a shutter second end bore 110. Operationally, the shutter first and second end walls 104 and 106 are pivotally mounted about the respective shutter first and second end bores 108 and 110 to the frame first and end walls 16 and 18, respectively. The shutter first and second end bores 108 and 110 are concentric with the frame first and second bores 36 and 38 and aligned along the longitudinal axis. Preferably, at least one shutter stop 112 depends from either of the shutter end walls 102 and 104, enabling the shutter 100 to rest in contact with the frame 10. Also, mating with the shutter stop 112 is a frame stop 113 which extends from the respective frame first and second end walls 16 and 18 to engage the shutter stop 112. Also preferable, the shutter first and second end walls 104 and 106 are identically shaped.

Disposed within the drum 40 is an elongated axle 114, which has an axle first end 116 and an axle second end 118. The axle 114 is cylindrically-shaped and aligns along the longitudinal axis. Proximate the axle first end, the axle reduces in diameter to form an axle first shoulder 120 and an axle first end shaft 122. T he axle first end shaft 122 extends through and rotatably engages the first spool bore 98, the drum first bore 48, the first wheel bore 62, the index bore 70 and the frame first bore 48, and extends the axle first end 116 beyond the frame first bore 48. An axle bar 124 is disposed along the axle first end shaft 122 and is formed by a first groove 126 and a second groove 128. Proximate the axle second end 118, the axle 114 reduces in diameter to form an axle second shoulder 130 and an axle second end shaft 132. The axle second end shaft 132 extends through and rotatably engages the drum second bore 50, the second wheel bore, the shutter second end bore 110 and the frame second bore 38, and extends the axle second end 118 beyond the frame second bore 38. In this embodiment, the axle first and second shoulders 120 and 130 slidingly engage the first spool 94 and drum second end wall 44, respectively, to prevent inadvertent removal of the axle 114 from the drum 40. Also in this embodiment, the axle 114 rotatably mounts the drum 40 and pivotally mounts the index arm 64 and the shutter 100 to the frame 10.

Mounted to the shutter first end wall 102 proximate the shutter first end bore 108, between the shutter first end wall 102 and the drum first end wall 42, is a horseshoe washer 134. Central to the horseshoe washer 134 is a U-shaped slot 136, which matingly engages the axle bar 124. The horseshoe washer 134 operationally connects the shutter 100 to the axle 114 and causes the axle 114 to rotate about the longitudinal axis as the shutter 100 pivots.

Within the drum 40, a spring 138 having a spool end 140 and an axle end 142 is disposed on the axle 114. The spool end 140 is mounted to the first spool 94 and the axle end 142 is mounted to the axle 114 by a spring set screw 144. In the preferred embodiment, the axle 114 has a spring groove 146 to receive the axle end 142. The spring set screw 144 locks the axle end 142 to the axle 114. By mounting the spring 138 in this manner, the spring 138 provides biasing for the index arm 64 and the shutter 100. To facilitate rotation of the drum 40, the spring 138 biases the index arm 64 away from the first ratchet Wheel 56. Limiting the travel of the index arm 64 is an arm stop (not shown) that engages and maintains contact with the index arm 64 as the index arm 64 pivots away from the first ratchet wheel 56. In this embodiment, the arm stop is a rectangularly shaped and mounted to the frame first end wall 16 proximate the wall rear edge 26. The arm stop protrudes toward the frame second end wall 18 and has sufficient length to engage the index arm 64 without contacting, the drum 40. As previously stated, the spring 138 provides biasing force to the shutter 100. Preferably, the shutter stop 112 is biased in contact with the frame 10 above the drum 40 in this embodiment. As the shutter 100 pivots downwardly to block the observer's view of the drum 40, the axle 114 rotates and causes tension to increase on the spring 138 due to the stationary position of the first spool 94. When the shutter 100 is released, the spring 138 releases the tension by causing the shutter 100 to pivot upwardly and bring the shutter stop 112 in contact with the frame stop 113.

Washers are provided to facilitate motion of the drum 40 and the shutter 100. For rotation of the drum 40, a first washer 148 is disposed upon the axle first end shaft 122 between the first ratchet wheel 56 and the index arm 64. A second washer 150 is disposed upon the axle first end shaft 122 between the shutter first end wall 102 and the frame first end wall 16.

The axle first and second ends 116 and 118 are received by a pair of mounting spools 152. The mounting spool 152 has a mounting spool flange 154, a threaded mounting spool shaft 156, a threaded mounting spool first bore 158 at the mounting spool shaft 156 and a mounting spool second bore (not shown) at the mounting spool flange 154. One mounting spool 152 is mounted to the frame first end wall outer surface 17 at the frame first bore 36. The other mounting spool 152 is mounted to the frame second end wall outer surface 19 at the frame second bore 38. The mounting spool second bores are concentric with the frame first and second bores 36 and 38 and are aligned along the longitudinal axis. Rotatably received within the respective mounting spool second bores are the axle first and second ends 116 and 118.

Rotatably disposed upon the respective mounting spool shafts 156 are V-shaped braces 160 for mounting the frame 10 to the vehicle 6, particularly to the rear window 4. Each brace 160 has a brace upper arm 162 and a brace lower arm 164. Proximate the end of the brace upper arm 162 is a brace upper arm bracket 166 and a suction cup 168 mounted to the brace upper arm bracket 166. Similarly, proximate the end of the brace lower arm 164 is a brace lower arm bracket 170 and a pad 172 mounted to the brace lower arm bracket 170. The suction cups 168 are capable of being mounted to any window of the vehicle 6, but it is preferred for the suction cups 168 to be mounted to the rear window 4. Between the brace upper and lower arms 162 and 164 is a brace hole 174, which is disposed on and rotatably engages the mounting spool shaft 156. To lock the braces 160 in a desired position, a thumb nut 176 having knurled outer nut surface 178 and a threaded nut bore 180 is placed on and rotated about the mounting spool shaft 156 until tightened against the respective brace 160. The threads of the nut bore 180 matingly engage the threads of the mounting spool shaft 156. An end screw 182 and end screw washer 184 are provided for each thumb nut 176 to maintain the thumb nut 176 on the mounting spool 152. The end screw 182 engages the mounting spool first bore 158 and the end screw washer 184 causing the end screw washer 184 to remain contact with the thumb nut 176.

A drum cable 186 is pivotally mounted to the index arm 64 proximate the arm mount end 66 for applying a first force to the first pawl 74. The drum cable 186 has an drum cable first end 188 and a drum cable second end 190, shown in FIG. 4. Pivotally mounted to the arm mount end 66 is Y-shaped shackle 192. The shackle 192 is secured to the index arm 64 at one end by a shackle screw 194, and the other end is mounted to the drum cable first end.

A shutter cable 196 is pivotally mounted to the shutter first end wall 102 for applying a second force to the shutter 100. The shutter cable 196 has a shutter cable first end 198 and a shutter cable second end 200. As with the drum cable 186, another shackle 192 is pivotally mounted to the shutter first end wall 102 at one end of the shackle 192 and at the other end is mounted the shutter cable first end 198. This shackle 192 is shown in phantom in FIG. 2 for the purpose of clarity.

The drum cable 186 and the shutter cable 196 are slidably disposed within a hollow core cover 202, which is mounted at one end to a cover mounting bracket (not shown). The cover mounting bracket is mounted to the frame first end wall 16 adjacent to the drum 40. Reference is now made to FIG. 4. At the other end of the cover 202, the cover 202 is attached to a cover receiving bracket 204. The cover receiving bracket 204 is mounted to a trigger grip 206.

The trigger grip 206 comprises an elongated housing 208 having elongated housing spaced side walls 210, a housing top wall 212, a housing bottom wall 214 spaced from the housing top wall 212 and a pulley cavity 216 disposed between the housing top and bottom walls 212 and 214. A cable receiving port 218 depends from at least one of the elongated housing spaced side walls 210 proximate the housing top wall 212 for engaging the cover receiving bracket 204. Each of the elongated housing spaced side walls 210 have a mounting port 220 disposed concentric to one another proximate the housing bottom wall 214 and coextensive with the pulley cavity 216. A shaft recess 222 is disposed within each of the elongated housing spaced side walls 210. Each shaft recess 222 is concentric with the mounting ports 220 and coextensive with the pulley cavity 216. Within the pulley cavity 216 is drum cable pulley 224 and a shutter cable pulley 226. The drum cable pulley 224 has a cylindrical drum pulley shaft 228, a drum pulley wall 230 depending from the drum pulley shaft 228 and a drum pulley slot 232. The drum pulley shaft 228 pivotally engages the shaft recess 222 of one of the elongated housing spaced side walls 210. Along the circumference of the drum pulley wall 230 is a drum pulley edge 234 and a drum cable groove 236 within and along the drum pulley edge 234. At a drum pulley recess 238 on the drum pulley edge 234, the drum cable second end 190 is mounted to the drum cable pulley 224. The shutter cable pulley 226 has a cylindrical shutter pulley shaft 240, a shutter pulley wall 242 depending from the shutter pulley shaft 240 and a shutter pulley slot 244. Similar to the arrangement of the drum pulley shaft 228, the shutter pulley shaft 240 pivotally engages the other shaft recess 222 and is substantially flush with the drum pulley shaft 228. Additionally, the shutter pulley slot 244 is substantially flush with the drum pulley slot 232. The shutter pulley wall 242 has a shutter pulley edge 246 along the circumference of the shutter pulley wall 242 and a shutter cable groove 248 within and along the shutter pulley edge 246. At a shutter pulley recess 250 on the shutter pulley edge 246, the shutter cable second end 200 is mounted to the shutter cable pulley 226.

An elongated trigger 252 has a cylindrically shaped trigger shaft 254 depending from the trigger 252, which pivotally and slidingly engages the mounting ports 220. At least one end of the trigger shaft 254 protrudes beyond the mounting ports 220 as the trigger shaft 254 slides within the mounting ports 220. Depending from the trigger shaft 254 is a trigger bar 256 that matingly and slidingly engages the drum and shutter pulley slots 232 and 144 independently or simultaneously. Each of the pulley slots 232 and 244 can be selectively and alternatively engaged by the trigger bar 256.

To rotate the drum 40 on this embodiment, the operator slides the trigger shaft 254 so that the trigger bar 256 matingly engages the drum pulley slot 232 of the drum cable pulley 224. The operator then applies a first force by hand to the trigger 252 by drawing the trigger 252 toward the housing 208. This action causes the drum cable pulley 224 to pivot, sliding the drum cable 186 within the cover 202 and causing the spring 138 to develop tension. The index arm 64 simultaneously pivots toward the drum 40, causes the first pawl 74 to engage a first tooth 60 of the first ratchet wheel 56 and apply the first force to the first tooth 60. As the first force continues to be applied to the first tooth 60, the drum 40 rotates until the first pawl 74 disengages the first tooth 60, due to the first tooth 60 rotating away from the first pawl. The second pawl 86 then engages one of the second teeth of the second ratchet wheel and prevent the drum 40 from rotating in the opposite direction. As the trigger 252 is released, the spring 138 releases the tension by causing the index arm 64 to pivot and contact the arm stop, while sliding the drum cable 186 within the cover 202 and returning the trigger 252 to its original position.

To pivot the shutter 100 on this embodiment, the operator slides the trigger shaft 254 so that the trigger bar 256 matingly engages the shutter pulley slot 244 of the shutter cable pulley 226. The operator then applies a second force by hand to the trigger 252 by drawing the trigger 252 toward the housing 208. This action causes the shutter cable pulley 226 to pivot, sliding the shutter cable 196 within the cover 202 and causing the spring 138 to develop tension. The shutter 100 simultaneously pivots over the drum 40, shielding a view of the side 46 of the drum 40 which is viewable from outside of the vehicle 6. As the trigger 252 is released, the spring 138 releases the tension by causing the shutter 100 to pivot upwardly until the shutter stop 112 engages the frame stop 113, sliding the shutter cable 196 within the cover 202 and returning the trigger 252 to its original position.

Figures 5, 7, 8:
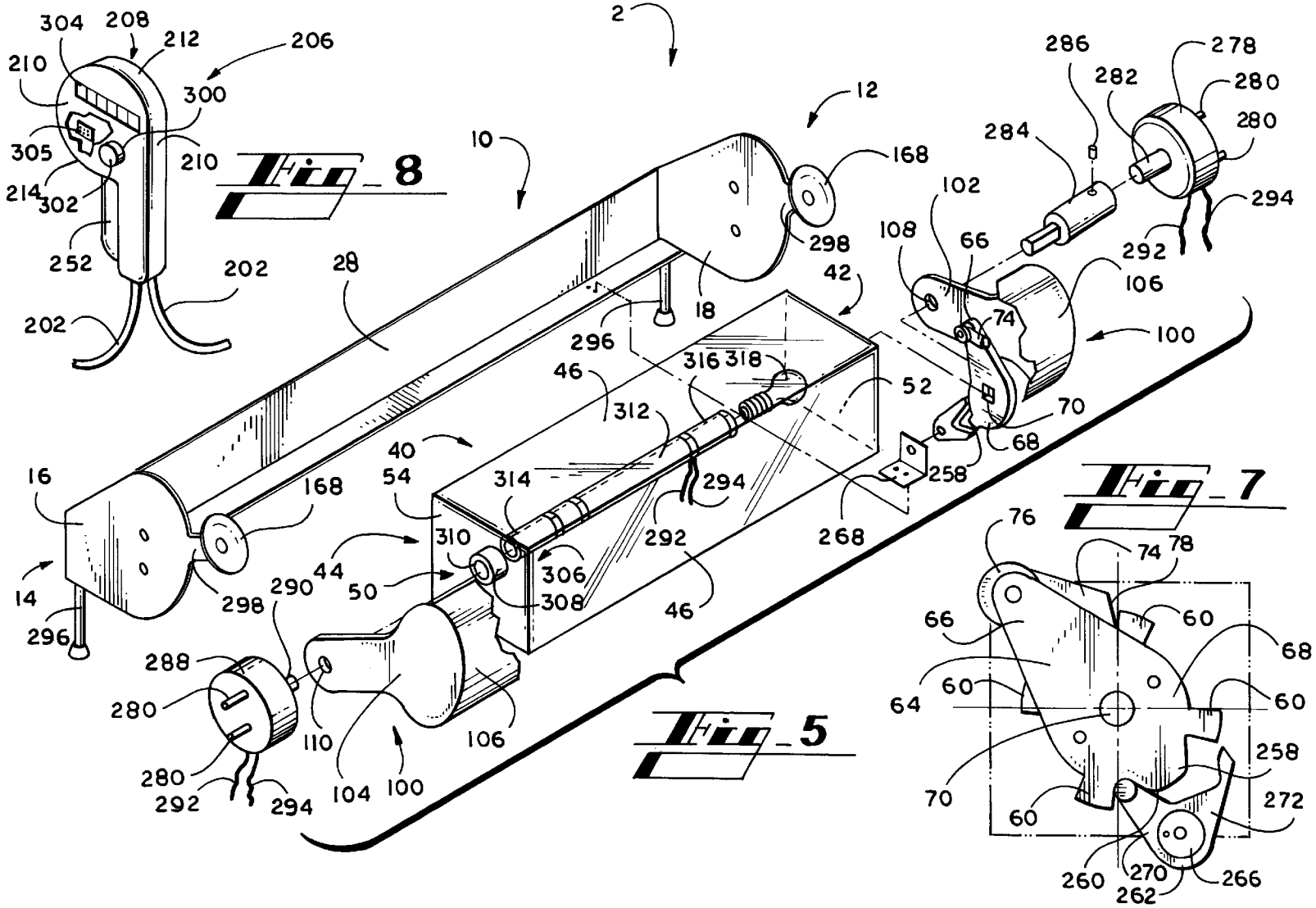
FIG. 5 is an exploded, perspective view of another embodiment of the vehicle signalling device.
FIG. 7 is a side, elevation view of the assembled arm and pawl shown in FIG. 6.
FIG. 8 is a perspective view of a trigger grip operationally connected to the embodiment shown in FIG. 5.

Referring to the embodiment shown in FIGS. 5–8, reference is next made to FIG. 5. This embodiment of the vehicle signalling device 2 has a frame 10 with a frame first end 12 and a frame second end 14. At the frame first and second ends 12 and 14 are a frame first end wall 16 and a frame second end wall 18, respectively. Preferably, the frame first and second end walls 16 and 18 are identically shaped and oriented parallel to one another. Disposed between the frame first and second end walls 16 and 18 is an elongated frame brace 28. In this embodiment, the frame brace 28 is also in an L-shaped configuration for strength and durability, but is not required. A longitudinal axis is as well disposed between the frame first and second end walls 16 and 18, generally parallel to the brace 28.

To displays messages to the viewer, an elongated, polygonal drum 40 is operationally and rotatably mounted to the frame first and second end walls 16 and 18. The drum 40 has a drum first end wall 42 and a drum second end wall 44, which are operatively and rotatably mounted to the frame first and second end walls 16 and 18, respectively, along the longitudinal axis. Each side 46 of the drum 40 has indicia 8 for conveying a predetermined message for viewing from outside of a vehicle 6, as shown in FIG. 1. The drum first end wall 42 has a drum first end outer surface 52, which is drawn in phantom in FIG. 5.

In addition to FIG. 5, reference is now made to FIGS. 6 and 7. To facilitate rotation of the drum 40, a first ratchet wheel 56 is mounted to the drum first end outer surface 52 proximate the center of the first end outer surface 52 and along the longitudinal axis. Generally, the first ratchet wheel 56 is circular in shape and has a first wheel circumferential surface 58. Depending from the first wheel circumferential surface 58 is a plurality of first teeth 60, the number of which is at least equal to the number of sides 46 of the drum 40. Also, the first ratchet wheel has a first wheel bore 62 that is concentric with the first wheel circumferential surface 58 and the drum first end wall 42 and is aligned along the longitudinal axis.

An index arm 64 having an arm mount end 66, an arm pivot end 68 and an index bore 70 is pivotally and operationally mounted to the frame first end wall 16 proximate the arm pivot end 68 at the index bore 70. The index bore 70 is aligned along the longitudinal axis and is concentric with the first wheel bore 62. Proximate the arm pivot end 68, a cam 258 depends from the index arm 64. The cam 258 has a sear engaging surface 260, which is located distal from the index bore 70.

Acting in union with the index arm 64 is a first pawl 74 having a first pawl pivot end 76 and a first pawl outer end 78. Proximate the first pawl pivot end 76, the first pawl 74 is pivotally mounted to the index arm 64 proximate the arm mount end 66 by a pawl mounting screw 80. The pawl mounting screw 80 matingly engages a first threaded hole 82 of the index arm 64. Preferably, as the index arm 64 pivots toward the drum 40, the first pawl outer end 78 removably and matingly engages a first tooth 60 of the first ratchet wheel 56. Engaging the first pawl 74 and biasing the first pawl outer end 78 in contact with the first ratchet wheel 56 is a first pawl spring 84. The first pawl spring 84 is disposed between the index arm 64 and the first pawl 74 over the pawl mounting screw 80.

To prevent over rotation of the drum 40, a sear 262 is provided to engage one of the first teeth 60 rotating toward the sear 262. The generally C-shaped sear 262 having two legs is pivotally mounted at a sear bore 264 about a sear pin 266 to a scar mounting bracket 268. The sear mounting bracket 268 is mounted to the frame brace 28 of the frame 10 proximate the index arm 64. One leg of the sear 262 is a first sear leg 270 that has a cam engaging end 274 distally located from the sear bore 264. The cam engaging end 274 engages the sear engaging surface 260 of the cam 258 as the index arm 64 pivots and causes the sear 262 to pivot as well. The other leg is a second sear leg 272 which has a tooth engaging end 276. As the sear 262 pivots, the tooth engaging end 276 contacts the first wheel circumferential surface 58 and engages one of the first teeth 60, which stops drum 40 rotation.

To selectively shield a view of the side 46 of the drum 40 which is viewable from outside of the vehicle 6, a shutter 100 is operationally and pivotally mounted to the frame 10. An operator can utilize the shutter 100 to block the observer's view while the drum 40 is rotating to the desired side 46. Once the desired side 46 is in place, the shutter 100 can be pivoted above or below the drum 40 to reveal the message to the observer. The shutter 100 has a shutter first end wall 102, a shutter second end wall 104 and an elongated blind 106 disposed between the shutter first and second end walls 102 and 104. Located on the shutter first end wall 102 is a shutter first end bore 108 and on the shutter second end wall 104 is a shutter second end bore 110. Operationally, the shutter first and second end walls 104 and 106 are operationally and pivotally mounted about the respective shutter first and second end bores 108 and 110 to the frame first and second end walls 16 and 18, respectively. The shutter first and second end bores 108 and 110 are aligned along the longitudinal axis. Preferably, the shutter first and second end walls 104 and 106 are identically shaped.

To rotate the drum, an electric, first motor 278 is mounted to the frame first end wall 18 by a pair of mounting prongs 280. The first motor 278 has a rotatable protruding motor stem 282 and a first motor shaft 284 mounted to the motor stem 282 by a shaft set screw 286. The first motor shaft 284 extends through the shutter first end bore 108 and the index bore 70 and rotatably mounts to the first wheel bore 62. In addition, the first motor shaft 284 matingly engages the index bore 70 so that the index arm 64 pivots when the first motor 278 is engaged. The first motor shaft 284 rotates X degrees from a first initial position upon activation of the first motor 278 and returning to the first initial position upon deactivation of the first motor 278, where X determined by the formula:

$$X = 360\text{degrees}/\text{number of sides of the drum.}$$

Pivoting the shutter 100 is an electric, second motor 288 mounted to the frame second end wall 16 by another pair of mounting prongs 280. The second motor 288 has one rotatable protruding motor stem 282 and a second motor shaft 290 mounted to the motor stem 282. Extending through the shutter second end bore 110, the second motor shaft 290 matingly engages the shutter second end bore 110. Although not required, the drum 40 can have a drum second bore 50 disposed on the drum second end wall and the second motor shaft 290 rotatably engaging the drum second bore 50. The drum second bore 50 is concentric with the drum first bore 48 and aligned along the longitudinal axis.

The first and second motors 278 and 288 are 12 volt electrical rotary motors. Several commercial electric motors are available which operate adequately in this embodiment, such as: Shindengen Electric Manufacturing Company, Limited model number 401, Lucas International model number 410b and Futaba International model number S148. Additionally, both motors 278 and 288 have positive and negative source wires 292 and 294 connecting the motors 278 and 288 to a power source not shown, such as the vehicle's electrical system or a battery. The wires 292 and 294 for both motors 278 and 188 are carried inside a cover 202, as shown in FIG. 8.

To mount the vehicle signalling device 2 to the vehicle 6, the frame 10 has a pair of elongated stands 296 and a pair of suction cups 168. Each stand 296 depends from the frame brace 28 proximate the frame first and second end walls 16 and 18. Depending from the frame first and second end walls 16 and 18, distally located from the frame bracket 28, are a pair of cup brackets 298. Each cup bracket 298 is rectangularly shaped and has a cup receiving port (not shown) to receive and mount the suction cup 168 to the frame 10.

Referring now to FIG. 8, the trigger grip 206 comprises an elongated housing 208 having elongated housing spaced side walls 210, a housing top wall 212, a housing bottom wall 214 spaced from the housing top wall 212 and a component cavity (not shown), which is similar to the pulley cavity 216 shown in FIG. 4, disposed between the housing top and bottom walls 212 and 214. One of the elongated housing spaced side walls 210 has a switch port 300 proximate the housing bottom wall 214. Coextensive with the component cavity are shaft recesses 222, having the same configuration as FIG. 4, disposed within each of the elongated housing spaced side walls 210. The shaft recesses are concentric to one another and are located proximate the housing bottom wall 214.

A drum switch (not shown) is operatively connected to the power source by an in-line connection to the positive source wire 292 and the first motor 278 for activating and deactivating the first motor 278. The drum switch is mounted to the elongated housing 208 within the component cavity and has an activation button 302 disposed within the switch port 300 that protrudes beyond the elongated housing spaced side wall 210.

A shutter switch (not shown) is operatively connected to the power source by an in-line connection to the positive source wire 292 and the second motor 288 for activating and deactivating the second motor 288. The shutter switch has an elongated trigger 252 and a shutter switch shaft (not shown) pivotally mounts within the shaft recesses 222.

On the exterior of one of the elongated housing spaced side walls 210 is a light emitting diode (LED) display 304 for indicating to the operator which side 46 of the drum 40 is viewable from outside of the vehicle 6. For example, the LED display 304 is capable of indicating an indicium such as the numeral "1" for a side 46 of the drum 40 which has been predesignated "side 1", and so on for sequential pairings. The LED display 304 is mounted to one of the elongated housing space side walls 210, preferably the same side having the switch port 300.

To sequentially activate the LED display 304, a solid state electronic sequencer 305 is disposed within the component cavity and operatively connected to both the LED display 304 and the drum switch. The sequencer 305 transmits a signal to the LED display 304 to indicate one sequential indicium relative to the side viewable from outside of the vehicle upon the activation of the drum switch. Both the LED display 304 and the sequencer 305 are operatively connected to the power source.

Either embodiment or any combination of the disclosed features within each embodiment thereof can be supplied with a lighted drum 40. Preferably, the drum 40 is made of clear plastic. Translucent plastic is also useable. Within the drum 40, the drum second end wall 44 has a drum second end inner surface 306. Depending from the drum second end inner surface 306 is a cylindrical drum inner spool 308 having a drum inner spool wall 310 disposed along the longitudinal axis. Mounted to the drum inner spool 308 is an elongated tube 312 having a first tube end 314 and a second tube end 316. The first tube end 314 inserts into and engages the drum inner spool wall 310. The drum 40 is illuminated by a lamp 318 which is removably mounted in the second tube end 316. Tile lamp 318 is operatively connected to the power source by Positive and negative source wires 292 and 294.

To rotate the drum 40 on this embodiment, the operator activates the drum switch by pressing the activation button 302. This action activates the first motor 278 to rotate its motor stem 282 and deliver a first force to the index arm 64, causing the index arm 64 to simultaneously pivot toward the drum 40, directing the first pawl 74 into contact with a first tooth 60 of the first ratchet wheel 56, which applies the first force to the first tooth 60. As the first force continues to be applied to the first tooth 60, the drum 40 rotates until the first pawl 74 disengages the first tooth 60, due to the first tooth 60 rotating away from the first pawl 74. The second pawl 86 then engages one of the second teeth of the second ratchet wheel and prevents the drum 40 from rotating in the opposite direction.

To pivot the shutter 100 on this embodiment, the operator activates the shutter switch by squeezing the trigger 252. This action activates the second motor 288 to rotate its motor stem 282 ninety degrees and deliver a second force to the shutter 100. This action causes the shutter 100 to pivot over the drum 40, shielding a view of the side 46 of the drum 40 which is viewable from outside of the vehicle 6. When the trigger 252 is released, the second motor 288 rotates in the opposite direction due to internal biasing and pivots the shutter 100 upwardly and returns the shutter 100 to its original position.

It is foreseeable, and covered within the scope of this invention, that the shutter 100 can be designed with two blinds 106, one blind 106 being pivoted upwardly and the other blind 106 pivoted downwardly away from the view of the drum 40. Also, it is foreseeable, and covered within the scope of this invention, for the motor stem 282 of the first motor 278 to directly engage the drum first bore 48 without the index arm 64 and the first pawl 74 to rotate the drum 40.

With respect to the above description then, it is to be realized that the optimum dimensional relationships for the parts of the invention, to include variations in size, materials, shape, form, function and manner of operation, assembly and use, arc deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

Various modifications may be made of the invention without departing from the scope thereof and it is desired, therefore, that only such limitations shall be placed thereon as are imposed by the prior art and which are set forth in the appended claims.

What is claimed is:

1. A rotatable, vehicle-signalling device, comprising:

a frame having an elongated brace, a frame first end wall, a frame second end wall and a longitudinal axis disposed between the frame first and second end walls;

an elongated, polygonal drum for displaying a predetermined message on each side thereof, the drum having a drum first end wall and a drum second end wall, the drum first and second end walls operatively and rotatably mounted to the frame first and second end walls, respectively, along the longitudinal axis and each side of the drum having indicia for conveying the predetermined message for viewing from outside of a vehicle;

a ratchet wheel mounted to the drum first end wall;

first means being operatively connected to the ratchet wheel for rotating the drum to display at least one side of the drum to a viewer; and a mounting means engaging the frame for mounting the frame to the vehicle.

2. A device as claimed in claim 1, further comprising a shutter for selectively shielding a view of the drum viewable from outside of the vehicle, the shutter having an elongated blind, a shutter first end wall and a shutter second end wall, and the shutter first and second end walls operatively and pivotally mounted to the frame first and second end walls, respectively.

3. A device as claimed in claim 2, further comprising second means operatively connected to the shutter for pivoting the shutter.

4. A device as claimed in claim 3, further comprising a hand-held means operatively connected to both the first means for actuating rotation of the drum and to the second means for actuating pivotal motion of the shutter.

5. A device as claimed in claim 1, further comprising a hand-held means operatively connected to the first means for actuating rotation of the drum.

6. A device as claimed in claim 1, wherein the mounting means is a V-shaped brace having a brace upper arm and a brace lower arm, the brace upper arm having a brace upper arm bracket and a suction cup mounted to the brace upper arm bracket, the brace lower arm having a brace lower arm bracket and a pad mounted to the brace lower arm bracket.

7. A device as claimed in claim 1 wherein the mounting means is at least one elongated stand depending from the brace, at least one cup bracket having a cup receiving port depending from one of the frame end walls, and a suction cup mounted to the cup receiving port.

8. A rotatable, vehicle-signalling device, comprising:

a frame having an elongated brace, a frame first end wall, a frame second end wall and a longitudinal axis disposed between the frame first and second end walls;

an elongated, polygonal drum for displaying a predetermined message on each side thereof, the drum having a drum first end wall and a drum second end wall, the drum first and second end walls operatively and rotatably mounted to the frame first and second end walls, respectively, along the longitudinal axis and each side of the drum having indicia for conveying the predetermined message for viewing from outside of a vehicle, the drum first end wall having a drum first end outer surface;

a first ratchet wheel mounted to the drum first end outer surface, the first ratchet wheel having a first wheel circumferential surface and a plurality of first teeth depending from the first wheel circumferential surface;

an index arm having an arm mount end and an arm pivot end and being operatively and pivotally mounted to the frame first end wall proximate the arm pivot end, a first pawl having a first pawl pivot end and a first pawl outer end and being pivotally mounted proximate the first pawl pivot end to the index arm proximate the mount end, the first pawl outer end removably engaging at least one first tooth of the first ratchet wheel;

first means operatively connected to the index arm for pivoting the index arm to cause the first pawl outer end to apply a first force to the at least one tooth of the first ratchet wheel and rotate the drum to display at least one side of the drum to a viewer; and a mounting means engaging the frame for mounting the frame to the vehicle.

9. A device as claimed in claim 8, further comprising a shutter for selective shielding a view of the drum viewable from outside of the vehicle, the shutter having an elongated blind, a shutter first end wall and a shutter second end wall, and the shutter first and second end wall operatively and pivotally mounted to the frame first and second end walls, respectively.

10. A device as claimed in claim 9, further comprising second means operatively connected to the shutter for pivoting the shutter.

11. A device as claimed in claim 10, further comprising a hand-held means operatively connected to both the first means for actuating rotation of the drum and to the second means for actuating pivotal motion of the shutter.

12. A device as claimed in claim 11, wherein:

the first means comprises a drum cable pivotally mounted to the index arm proximate the arm mount end for applying the first force to the first pawl;

the second means comprises a shutter cable pivotally mounted to the shutter first end wall for applying a second force to the shutter;

the drum cable and the shutter cable are slidably disposed within a cover, the cover is mounted at one end to the to the frame; and the hand-held means comprises:

an elongated housing, the housing has elongated housing spaced side walls, a housing top wall, a housing bottom wall spaced from the housing top wall and a pulley cavity disposed between the housing top and bottom walls, the housing top wall has a cable receiving port, the other end of the cover mounted to the housing proximate the cable receiving port;

the elongated housing spaced side walls each has a mounting port disposed concentric to one another proximate the housing bottom wall and coextensive with the pulley cavity;

a shaft recess disposed within each elongated housing spaced side walls concentric with the mounting ports and coextensive with the pulley cavity;

a drum cable pulley pivotally mounted within the pulley cavity, the drum cable pulley has a drum pulley shaft, a drum pulley wall and a drum pulley slot, the drum pulley shaft pivotally engages one of the shaft recesses, the drum pulley wall has a drum pulley edge, the drum cable is mounted to the drum pulley edge;

a shutter cable pulley pivotally mounted within the pulley cavity and adjacent to the drum cable pulley, the shutter cable pulley has a shutter pulley shaft, a shutter pulley wall and a shutter pulley slot, the shutter pulley shaft is substantially flush with the drum pulley shaft, the shutter pulley slot is substantially flush with the drum pulley slot, the shutter pulley shaft pivotally engages the other shaft recess, and an elongated trigger has a trigger shaft depending from the trigger, the trigger shaft pivotally and slidingly engages the mounting ports, the trigger shaft has a trigger bar and the trigger bar selectively and slidingly engages the drum pulley slot and the shutter pulley slot.

13. A device as claimed in claim 12, wherein:

the index arm has an index bore proximate the arm pivot end, the drum first end wall has a drum first bore, the drum second end wall has a drum second bore, the first ratchet wheel has a first wheel bore, the frame first end wall has a frame first bore, the frame second end wall has a frame second bore;

the index bore, the drum first bore, the drum second bore, the first wheel bore, the frame first bore and the frame second bore are concentric with one another and are aligned along the longitudinal axis.

14. A device as claimed in claim 13, further comprising:

a cylindrically-shaped first spool disposed through the index bore and mounted to the index arm, the first spool having a first spool bore, the first spool bore being concentric with the index bore;

an elongated axle having an axle first end and an axle second end disposed within the drum and operationally connected to the shutter to rotate as the shutter pivots, the axle first end rotatably engaging the first spool bore, the axle first and second ends extending beyond the frame first and second bores, respectively;

an arm stop mounted to the frame first end wall;

at least one shutter stop depending from the shutter first end wall; and a spring being disposed on the axle and within the drum to bias both the index arm in contact with the arm stop and the shutter stop in contact with the frame, the spring being mounted at one end to the axle and at the other end to the first spool.

15. A device as claimed in claim 11, wherein:

the index arm has an index bore;

the first means comprises an electric, first motor mounted to the frame first end wall, the first motor having a rotatable, first motor shaft, the first motor shaft matingly engaging the index bore and an electrical power source operatively connected to the first motor;

the second means comprises an electric, second motor mounted to the frame second end wall, the second motor having a rotatable second motor shaft connected to the shutter second end wall and the second motor operatively connected to the power source; and the hand-held means comprises an elongated housing, the housing having elongated housing spaced side walls, a housing top wall, a housing bottom wall spaced from the housing top wall and a component cavity disposed between the housing top and bottom walls, at least one of the elongated housing spaced side walls having a switch port, the elongated housing spaced side walls each having a shaft recess disposed concentric to one another proximate the housing bottom wall, a drum switch operatively connected to the power source and the first motor for activating and deactivating the first motor, the drum switch mounted to the elongated housing within the component cavity and having an activation button disposed within the switch port and protruding beyond the at least one of the elongated housing spaced side walls, and a shutter switch operatively connected to the power source and the second motor for activating and deactivating the second motor, the shutter switch having an elongated body and a shutter switch shaft, the shutter switch shaft pivotally mounted within the shaft recesses.

16. A device as claimed in claim 15, wherein the hand-held means further comprising:

a light emitting diode (LED) display for indicating the side of the drum viewable from outside of the vehicle, the LED display being mounted to at least one of the elongated housing space side walls, a solid-state electronic sequencer disposed within the component cavity and operatively connected to both the LED display and the drum switch, the sequencer transmitting a signal to the LED display to indicate at least one sequential indicium relative to the side viewable from outside of the vehicle upon the activation of the drum switch, and the LED display and the sequencer being operatively connected to the power source.

17. A device as claimed in claim 10, wherein the second means comprises:

an electric, second motor mounted to the frame second end wall, the second motor having a rotatable second motor shaft connected to the shutter second end wall, and an electrical power source operatively connected to the second motor.

18. A device as claimed in claim 10 wherein the second motor shaft rotates at least ninety degrees from a second initial position upon activation of the second motor by the power source and returns to the second initial position upon deactivation of the second motor.

19. A device as claimed in claim 10 wherein the second means comprises a shutter cable pivotally mounted to the shutter first end wall for applying a second force to the shutter.

20. A device as claimed in claim 8, further comprising a hand-held means operatively connected to the first means for actuating rotation of the drum.

21. A device as claimed in claim 20 wherein the first means comprises a drum cable slidably disposed within a cover, the drum cable pivotally mounted to the index arm proximate the arm mount end for applying the first force to the first pawl and the cover mounted at one end to the frame, and the hand-held means comprises:

an elongated housing, the housing having elongated housing spaced side walls, a housing top wall, a housing bottom wall spaced from the housing top wall and a pulley cavity disposed between the housing top and bottom walls, the housing top wall having a cable receiving port, the other end of the cover mounted to the housing proximate the cable receiving port;

the elongated housing spaced side walls each having a mounting port disposed concentric to one another proximate the housing bottom wall and coextensive with the pulley cavity;

a shaft recess disposed within each elongated housing spaced side walls concentric with the mounting ports and coextensive with the pulley cavity;

a drum cable pulley pivotally mounted within the pulley cavity, the drum cable pulley having a drum pulley shaft, a drum pulley wall and a drum pulley slot, the drum pulley shaft pivotally engaging the shaft recesses, the drum pulley wall having a drum pulley edge, the drum cable being mounted to the drum pulley edge; and an elongated trigger having a trigger shaft depending from the trigger, the trigger shaft pivotally engaging the mounting ports, the trigger shaft having a trigger bar and the trigger bar engaging the drum pulley slot.

22. A device as claimed in claim 20, wherein:

the index arm has an index bore;

the first means comprises an electric, first motor mounted to the frame first end wall, the first motor having a rotatable, first motor shaft, the first motor shaft matingly engaging the index bore, and an electrical power source operatively connected to the first motor;

the hand-held means comprises an elongated housing, the housing having elongated housing spaced side walls, a housing top wall, a housing bottom wall spaced from the housing top wall and a component cavity disposed between the housing top and bottom walls, at least one of the elongated housing spaced side walls having a switch port, and a drum switch operatively connected to the power source and the first motor for activating and deactivating the first motor, the drum switch mounted to the elongated housing within the component cavity and housing an activation button disposed within the switch port and protruding beyond the at least one of the elongated housing spaced side walls.

23. A device in claim 8, wherein the first means comprises a drum cable pivotally mounted to the index arm proximate the arm mount end for applying the first force to the first pawl.

24. A device as claimed in claim 23, wherein the drum cable has a cover, the drum cable is slidably disposed within the cover and the cover is mounted at one end to the to the frame, and further comprises:

an elongated housing, the housing having elongated housing spaced side walls, a housing top wall, a housing bottom wall spaced from the housing top wall and a pulley cavity disposed between the housing top and bottom walls, the housing top wall having a cable receiving port, the other end of the cover mounted to the housing proximate the cable receiving port;

the elongated housing spaced side walls each having a mounting port disposed concentric to one another proximate the housing bottom wall and coextensive with the pulley cavity;

a shaft recess disposed within each elongated housing spaced side walls concentric with the mounting ports and coextensive with the pulley cavity;

a drum cable pulley pivotally mounted within the pulley cavity, the drum cable pulley having a drum pulley shaft, a drum pulley wall and a drum pulley slot, the drum pulley shaft pivotally engaging the shaft recesses, the drum pulley wall having a drum pulley edge, the drum cable being mounted to the drum pulley edge; and an elongated trigger having a trigger shaft depending from the trigger, the trigger shaft pivotally engaging the mounting ports, the trigger shaft having a trigger bar and the trigger bar engaging the drum pulley slot.

25. A device as claimed in claim 8, wherein the drum second end wall has a drum second end outer surface and further comprises:

a second ratchet wheel mounted to the drum second end outer surface, the second ratchet wheel having a second wheel circumferential surface and a plurality of second teeth depending from the second wheel circumferential surface, the number of second teeth being at least equal to the number of sides of the drum, and a second pawl having a second pawl pivot end and a second pawl outer end and being pivotally mounted to the frame second end wall proximate the second pawl pivot end, and the second pawl outer end removably and matingly engaging at least one second tooth of the second ratchet wheel, wherein the drum rotates unidirectionally.

26. A device as claimed in claim 8, wherein the mounting means is a V-shaped brace having a brace upper arm and a brace lower arm, the brace upper arm having a brace upper arm bracket and a suction cup mounted to the brace upper arm bracket, the brace lower arm having a brace lower arm bracket and a pad mounted to the brace lower arm bracket.

27. A device as claimed in claim 8, wherein the index arm has an index bore and the drum first end wall has a drum first bore, and the first means comprises:

an electric, first motor mounted to the frame first end wall, the first motor having a rotatable, first motor shaft, the first motor shaft matingly engaging the index bore, and an electrical power source operatively connected to the first motor.

28. A device as claimed in claim 27, wherein the index arm has a cam depending from the index arm proximate the arm pivot end, the cam having a sear engaging surface, and further comprises:

a sear mounting bracket mounted to the frame proximate the index arm, and a C-shaped sear pivotally mounted to the sear mounting bracket, the sear having a first sear leg and a second sear leg, the first sear leg having a cam engaging end, the second sear leg having a tooth engaging end, and the cam engaging end engages the sear engaging surface of the cam as the index arm pivots, causing the scar to pivot and place the tooth engaging end in contact with the first wheel circumferential surface to engage at least one of the first teeth, whereby rotation of the drum terminates.

29. A device as claimed in claim 27, wherein the first motor shaft rotates at least X degrees from a first initial position upon activation of the first motor by the power source, where X is determined by the formula:

$$X = 360 \text{ degrees/the number of sides of the drum.}$$

30. A device as claimed in claim 8, wherein the drum is at least translucent, the drum second end wall has a drum second end inner surface, the drum second end inner surface has a depending, cylindrical drum inner spool disposed along the longitudinal axis, the drum inner spool has a drum inner spool wall, and further comprising:

an elongated tube having a first tube end and a second tube end, the first tube end engaging the drum inner spool wall, a lamp removably mounted in the second tube end for illuminating the drum, and a power source operatively connected to the lamp.

31. A device as claimed in claim 8, wherein the mounting means is at least one elongated stand depending from the brace, at least one cup bracket having a cup receiving port depending from one of the frame end walls, and a suction cup mounted to the cup receiving port.

32. A rotatable, vehicle-signalling device, comprising:

a frame having an elongated brace, a frame first end wall, a frame second end wall and a longitudinal axis disposed between the frame first and second end walls;

an elongated, polygonal drum for displaying a predetermined message on each side thereof, the drum having a drum first end wall and a drum second end wall, the drum first and second end walls rotatably mounted to the frame first and second end walls, respectively, along the longitudinal axis and each side of the drum having indicia for conveying the predetermined message for viewing from outside of a vehicle, the drum first end wall having a drum first end outer surface, the drum second end wall having a drum second end outer surface;

a first ratchet wheel mounted to the drum first end outer surface, the first ratchet wheel having a first wheel circumferential surface and a plurality of first teeth depending from the first wheel circumferential surface;

an index arm having an arm mount end and an arm pivot end and being pivotally mounted to the frame first end wall proximate the arm pivot end;

a first pawl having a first pawl pivot end and a first pawl outer end and being pivotally mounted proximate the first pawl pivot end to the index arm proximate the mount end, the first pawl outer end removably engaging at least one first tooth of the first ratchet wheel;

a shutter for selectively shielding a view of the drum viewable from outside of the vehicle, the shutter having an elongated blind, a shutter first end wall and a shutter second end wall, and the shutter first and second end walls pivotally mounted to the frame first and second end walls, respectively;

the index arm having an index bore proximate the pivot end, the drum first end wall having a drum first bore, the drum second end wall having a drum second bore, the first ratchet wheel having a first wheel bore, the frame first end wall having a frame first bore, the frame second end wall having a frame second bore;

the index bore, the drum first bore, the drum second bore, the first wheel bore, the frame first bore and the frame second bore being concentric with one another and aligned along the longitudinal axis;

a cylindrically-shaped first spool disposed through the index bore and mounted to the index arm, the first spool having a first spool bore, the first spool bore being concentric with the index bore;

an elongated axle having an axle first end and an axle second end disposed within the drum, the axle first end rotatably engaging the first spool bore, the axle first and second ends extending beyond the frame first and second bores, respectively;

an arm stop mounted to the frame first end wall;

at least one shutter stop depending from the shutter first end wall;

a spring being disposed on the axle and within the drum to bias both the index arm in contact with the arm stop and the shutter stop in contact with the frame, the spring being mounted at one end to the axle and at the other end to the first spool;

a second ratchet wheel mounted to the drum second end outer surface, the second ratchet wheel having a second wheel circumferential surface and a plurality of second teeth depending from the second wheel circumferential surface;

a second pawl having a second pawl pivot end and a second pawl outer end and being pivotally mounted to the frame second end wall proximate the second pawl pivot end, and the second pawl outer end removably and matingly engaging at least one second tooth of the second ratchet wheel to maintain a unidirectional drum rotation;

a V-shaped brace rotatably engaging each frame end wall for mounting the frame to the vehicle, the brace having a brace upper arm and a brace lower arm, the brace upper arm having a brace upper arm bracket and a suction cup mounted to the brace upper arm bracket, the brace lower arm having a brace lower arm bracket and a pad mounted to the brace lower arm bracket;

a drum cable pivotally mounted to the index arm proximate the arm mount end for applying a first force to the first pawl;

a shutter cable pivotally mounted to the shutter first end wall for applying a second force to the shutter;

the drum cable and the shutter cable being slidably disposed within a cover, the cover being mounted at one end to the to the frame;

an elongated housing, the housing having elongated housing spaced side walls, a housing top wall, a housing bottom wall spaced from the housing top wall and a pulley cavity disposed between the housing top and bottom walls, the housing top wall having a cable receiving port, the other end of the cover mounted to the housing proximate the cable receiving port;

the elongated housing spaced side walls each having a mounting port disposed concentric to one another proximate the housing bottom wall and coextensive with the pulley cavity;

a shaft recess disposed within each elongated housing spaced side walls concentric with the mounting ports and coextensive with the pulley cavity;

a drum cable pulley pivotally mounted within the pulley cavity, the drum cable pulley having a drum pulley shaft, a drum pulley wall and a drum pulley slot, the drum pulley shaft pivotally engaging one of the shaft recesses, the drum pulley wall having a drum pulley edge, the drum cable being mounted to the drum pulley edge;

a shutter cable pulley pivotally mounted within the pulley cavity and adjacent to the drum cable pulley, the shutter cable pulley having a shutter pulley shaft, a shutter pulley wall and a shutter pulley slot, the shutter pulley shaft being substantially flush with the drum pulley shaft, the shutter pulley slot being substantially flush with the drum pulley slot, the shutter pulley shaft pivotally engaging the other shaft recess; and an elongated trigger having a trigger shaft depending from the trigger, the trigger shaft pivotally and slidingly engaging the mounting ports, the trigger shaft having a trigger bar and the trigger bar selectively and slidingly engaging the drum pulley slot and the shutter pulley slot alternatively.

33. A rotatable, vehicle-signalling device, comprising:

a frame having an elongated brace, a frame first end wall, a frame second end wall and a longitudinal axis disposed between the frame first and second end walls;

an elongated, polygonal drum for displaying a predetermined message on each side thereof, the drum having a drum first end wall and a drum second end wall, the drum first and second end walls operatively and rotatably mounted to the frame first and second end walls, respectively, along the longitudinal axis and each side of the drum having indicia for conveying the predetermined message for viewing from outside of a vehicle, the drum first end wall having a drum first end outer surface, the drum second en having a drum second end outer surface, the drum being at least translucent, the drum second end wall having a drum second end inner surface, the drum second end inner surface having a depending, cylindrical drum inner spool disposed along the longitudinal axis, the drum inner spool having a drum inner spool wall;

a first ratchet wheel mounted to the drum first end outer surface, the first ratchet wheel having a first wheel circumferential surface and a plurality of first teeth depending from the first wheel circumferential surface;

an index arm having an arm mount end, an arm pivot end and an index bore, the index arm being operatively and pivotally mounted to the frame first end wall proximate the arm pivot end, the index arm having a cam depending from the index arm proximate the arm pivot end, the cam having a sear engaging surface;

a sear mounting bracket mounted to the frame proximate the index arm;

a C-shaped sear pivotally mounted to the sear mounting bracket, the sear having a first sear leg and a second sear leg, the first sear leg having a cam engaging end, the second sear leg having a tooth engaging end, and the cam engaging end engages the sear engaging surface of the cam as the index arm pivots, causing the sear to pivot and place the tooth engaging end in contact with the first wheel circumferential surface to engage at least one first tooth, whereby rotation of the drum terminates;

a first pawl having a first pawl pivot end and a first pawl outer end and being pivotally mounted proximate the first pawl pivot end to the index arm proximate the mount end, the first pawl outer end removably engaging at least one tooth of the first ratchet wheel;

at least one elongated stand depending from the brace, at least one cup bracket having a cup receiving port depending from one of the frame end walls, and a suction cup mounted to the cup receiving port for mounting the frame to the vehicle;

a shutter for selectively shielding a view of the drum viewable from outside of the vehicle, the shutter having an elongated blind, a shutter first end wall and a shutter second end wall, and the shutter first and second end walls operatively and pivotally mounted to the frame first and second end walls, respectively;

an electric, first motor mounted to the frame first end wall, the first motor having a rotatable, first motor shaft, the first motor shaft matingly engaging the index bore, the first motor shaft rotating at least X degrees from a first initial position upon activation of the first motor, where X is determined by the formula:

$$X=360 \text{ degrees/number of sides of the drum;}$$

an electric, second motor mounted to the frame second end wall, the second motor having a rotatable second motor shaft connected to the shutter second end wall;

an electrical power source operatively connected to the first and second motors;

an elongated housing, the housing having elongated housing spaced side walls, a housing top wall, a housing bottom wall spaced from the housing top wall and a component cavity disposed between the housing top and bottom walls, at least one of the elongated housing spaced side walls having a switch port, the elongated housing spaced side walls each having a shaft recess disposed concentric to one another proximate the housing bottom wall;

a drum switch operatively connected to the power source and the first motor for activating and deactivating the first motor, the drum switch mounted to the elongated housing within the component cavity and having an activation button disposed within the switch port and protruding beyond the at least one of the elongated housing spaced side walls;

a shutter switch operatively connected to the power source and the second motor for activating and deactivating the second motor, the shutter switch having an elongated body and a shutter switch shaft, the shutter switch shaft pivotally mounted within the shaft recesses;

a light emitting diode (LED) display for indicating the side of the drum viewable from outside of the vehicle, the LED display being mounted to at least one of the elongated housing space side walls;

a solid state electronic sequencer disposed within the component cavity and operatively connected to both the LED display and the drum switch, the sequencer transmitting a signal to the LED display to indicate at least one sequential indicium relative to the side viewable from outside of the vehicle upon the activation of the drum switch;

the LED display and the sequencer being operatively connected to the power source;

an elongated tube having a first tube end and a second tube end, the first tube end engaging the drum inner spool wall;

a lamp removably mounted in the second tube end for illuminating the drum; and the power source operatively connected to the lamp.

* * * * *